US005984726A

United States Patent [19]

Wu

[11] Patent Number: 5,984,726

[45] Date of Patent: Nov. 16, 1999

[54] SHIELDED ELECTRICAL CONNECTOR

[75] Inventor: Kun-Tsan Wu, Tu-Chen, Taiwan

[73] Assignee: Hon Hai Precision Ind. Co., Ltd., Taipei Hsien, Taiwan

[21] Appl. No.: 08/870,778

[22] Filed: Jun. 6, 1997

[30] Foreign Application Priority Data

Jun. 7, 1996 [CN] China ..... 85208558
Jul. 18, 1996 [CN] China ..... 85210940

[51] Int. Cl.[6] ..... H01R 13/648

[52] U.S. Cl. ..... 439/607; 439/954

[58] Field of Search ..... 439/954, 907, 439/607, 609, 939

[56] References Cited

U.S. PATENT DOCUMENTS 3,596,235 7/1971 Teurlings et al. ..... 439/907
5,207,597 5/1993 Kline et al. ..... 439/607
5,288,248 2/1994 Chen ..... 439/609
5,588,844 12/1996 Sipe ..... 439/907
5,622,523 4/1997 Kan et al. ..... 439/939
5,755,595 5/1998 Davis et al. ..... 439/609

*Primary Examiner*—Gary F. Paumen

[57] ABSTRACT

An shielded electrical connector comprises an insulating housing, a plurality of conductive contacts received in a plurality of passageways defined in the housing, and standoff means for standing off on a circuit board in either a vertical arrangement in which the front mating face of the main body faces an upward direction or a horizontal arrangement in which the mating face facing a lateral direction. A shielding device surrounds the housing for prevent from electromagnetic interference. The shielding device is either manufactured as a unitary piece by stamping and bending or further comprises second shell as a two-piece design. The conductive contacts comprises a front contacting section including a stress-releasing portion for distributing stresses.

15 Claims, 17 Drawing Sheets

SHIELDED ELECTRICAL CONNECTOR

BACKGROUND OF THE INVENTION

1. Field of The Invention

The invention relates to an electrical connector, particularly to a Universal Serial Bus (USB) connector having shielding device thereon for latchably coupling to a complementary cable connector.

2. The Prior Art

There is a trend in the computer field to use USB connectors in place of most of the I/O connectors, such as D-Sub connectors and Mini-Dins. As can be seen in FIG. 1, a USB connector disclosed in Taiwan Patent Applications Nos. 84213585 and 84213586 assigned to the same applicant, generally designated at 1, mainly comprises an insulating housing 2, a front shell 3 and a rear shell 4. In assembling, a number of contacts (not shown) will be disposed in the housing and these contacts extend downward out of the housing 2 for wave soldering to an exterior circuit board. Thus, the transmission of electrical signals may be prevented from external electromagnetic interference owing to the shielding device. Other similar connectors of this type and their related parts can be found in Taiwan Patent Applications Nos. 85301901, 85301709, 79203382, 79204719, 79203005, 79211295, 81200270, 81204407, 82217806, 83101476 and 85202863. These connectors, however, encounter some problems.

In wave soldering, molten solders and flux may be sucked into the connectors owing to capillary effect because the bottoms of the connectors get too close to the surface of the circuit board they resting on. The molten solders and flux penetrated into the interior of the connectors may do harm to the transmission of electrical signals.

In addition, the housings of traditional connectors fall into the vertical type connectors and the horizontal type connectors to meet the requirements of different insertion directions of a mating connector. This increases both the manufacturing cost of the manufacturer and the inventory cost of the vendor.

Moreover, in some of the conventional connectors which grounding tabs are attached to the shielding device, different grounding tabs are attached to the shielding devices by means of various different securing means, such as bolt and nuts, fasteners, etc.; this also increases the inventory cost. While in the other conventional connectors which grounding tabs are integrally formed on the shielding device, such as the one disclosed in FIG. 1, a number of inward deflected grounding tabs 7 are integrally formed on the peripheries of a pair of symmetric openings 6 defined in the front surface of the shell 3 for engagement with the metal casing of a mating connector (not shown) to constitute grounding paths for the connector 1. This shielding device, however, has the shortcoming that it is difficult for a mating connector to be withdrawn from the connector 1 owing to the inward deflected grounding tabs 7.

Besides, some conventional connectors do not include grounding means possessing clipping function on their shielding devices, and thus may not provide an excellent engagement effect to a mating connector. Other connectors, though include grounding means possessing clipping function on their shielding devices, still provide poor engagement effect to a mating connector.

Furthermore, traditional connectors have a lower strength due to their structures, which encounter a deformation problem of the shielding device while a mating connector is inserted or withdrawn therefrom.

Hence, there is a need for a shielded electrical connector at can overcome the above-mentioned problems and shortcomings.

SUMMARY OF THE INVENTION

Accordingly, one object of the present invention is to provide a USB connector having a housing of standoff design to void molten solders and flux penetrating into the interior of the connectors.

Another object of the present invention is to provide a USB connector having a housing adapted to meet the requirements of different insertion directions of a mating connector.

Still another object of the present invention is to provide a USB connector having a shielding device including grounding tabs integrally formed thereon which are adapted to facilitate the withdrawal of a mating connector.

Another object of the present invention is to provide a USB connector including a shielding device including grounding means possessing an excellent clipping effect for firmly receiving a mating connector therein and providing excellent engagement effect thereto.

One more object of the present invention is to provide a USB connector including a shielding device including grounding means possessing clipping function integrally formed thereon.

Still another object of the present invention is to provide a USB connector including a shielding device having an reinforcement structure to eliminate the deformation problem while a mating connector is inserted into or withdrawn from the connector.

To fulfill the above-mentioned objects, according to one embodiment of the present invention, an electrical connector, comprises an insulating housing having a front face for mating a mating connect, a plurality of passageways defined in the housing and perpendicular to the front face, and standoff means for standing off on a circuit board in one of the two arrangements: a vertical arrangement in which the front mating face of the main body facing an upward direction and a horizontal arrangement in which the mating face facing a lateral direction; and a plurality of contacts received in the plurality of passageways and extending out of a rear face of the housing.

In another embodiment, the electrical connector comprises a shielding device surrounding the housing for preventing electromagnetic interference. In one preferred embodiment, the shielding device is manufactured as a unitary piece by stamping and bending, while in another preferred embodiment, the shielding device further comprises a second shell as a two-piece design.

In still another embodiment, the contacts comprises a middle fixing section for fixing into one of the passageways of the housing; a rear inserting section extending out of the housing for inserting into an external circuit board; and a front contacting section including a contacting portion convex through the aperture of the central portion of the housing into the annular recess for engaging a mating contact of a mating connector and a stress-releasing portion concave towards but not contacting an inner surface of the passageway for distributing stresses generated on the conductive contact. The contacting portion and the stress-releasing portion are two continuous curved portions and the stress-releasing portion abuts the inner surface of the passageway when the contacting portion of the contact is fully pressed by a mating contact of a mating connector.

These and additional objects, features, and advantages of the present invention will be apparent from a reading of the following detailed description of the embodiments of the invention taken in conjunction with the appended drawing figures, which are described briefly immediately below.

DETAILED DESCRIPTION OF THE PREFERRED EMBODIMENTS

Figure 1:
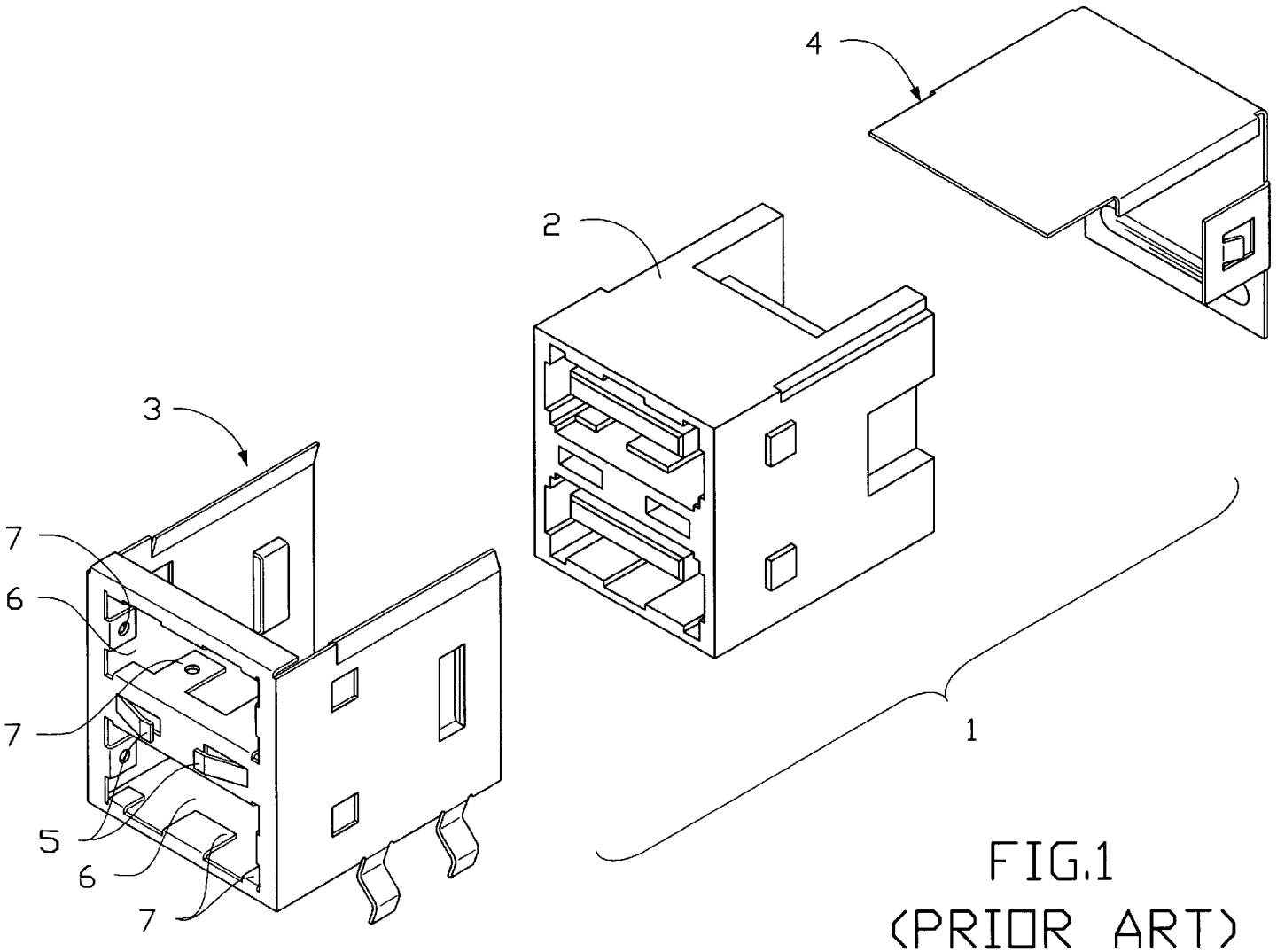
FIG.1 (PRIOR ART)
FIG. 1 is a perspective view of a conventional USB connector.

Reference will now be made in detail to the preferred embodiments of the present invention. It will be noted here that for a better understanding, most of like components are designated by like reference numerals throughout the various figures in the embodiments.

Figure 2:
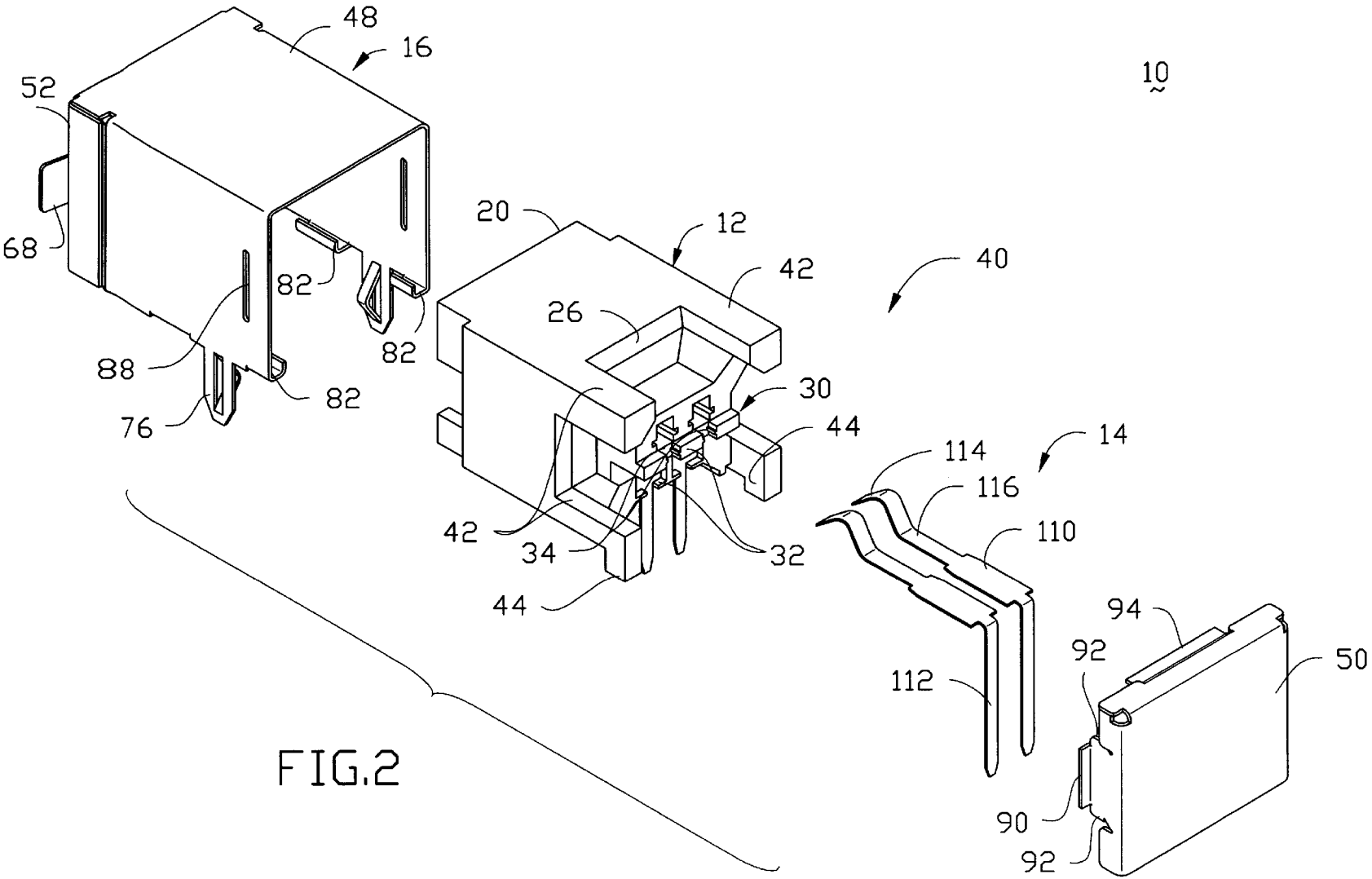
FIG. 2 is an exploded perspective view of a USB connector according to one embodiment of the present invention.
Figure 3:
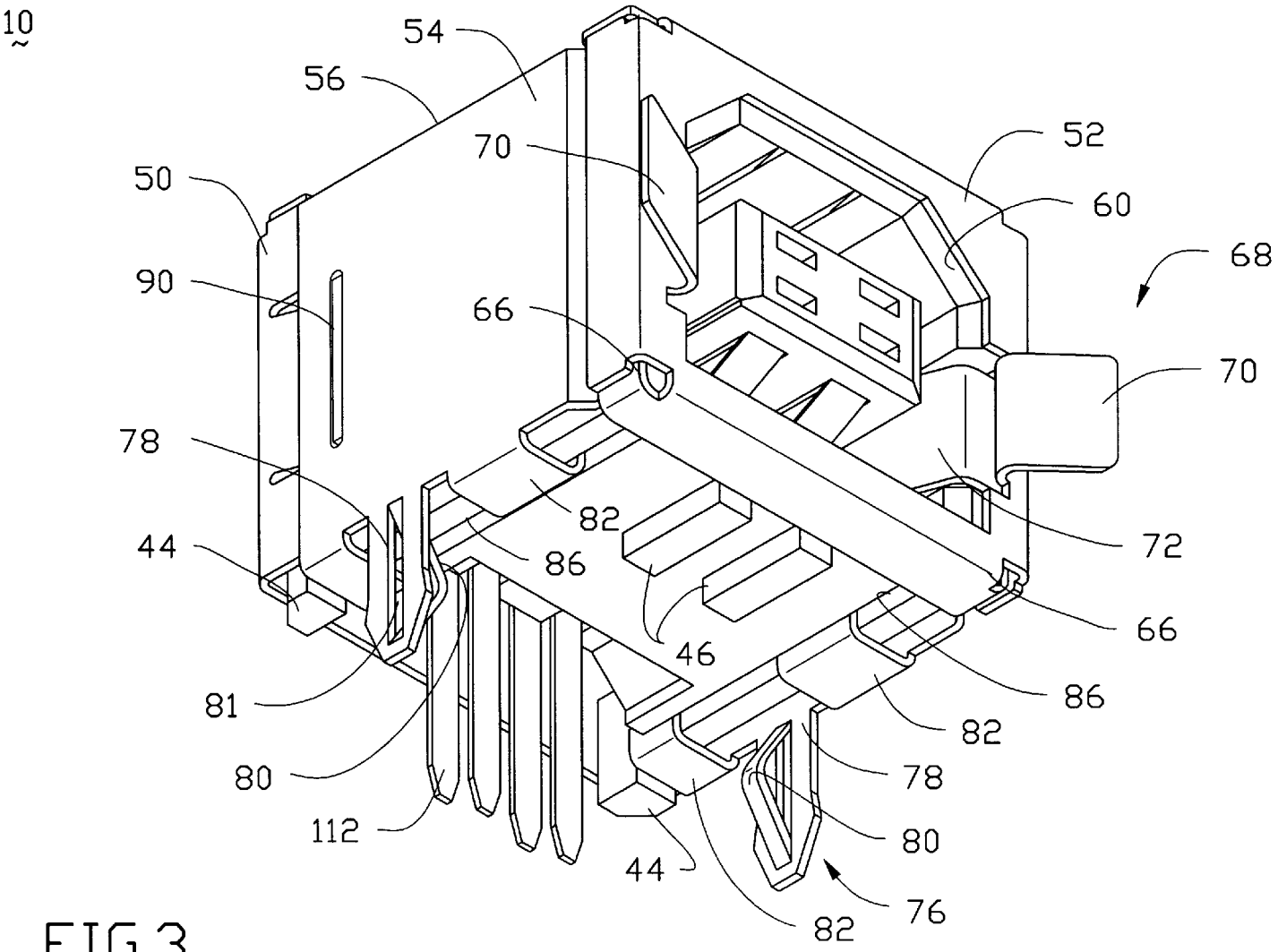
FIG. 3 is an assembled perspective view of a USB connector shown in FIG. 2.
Figure 4:
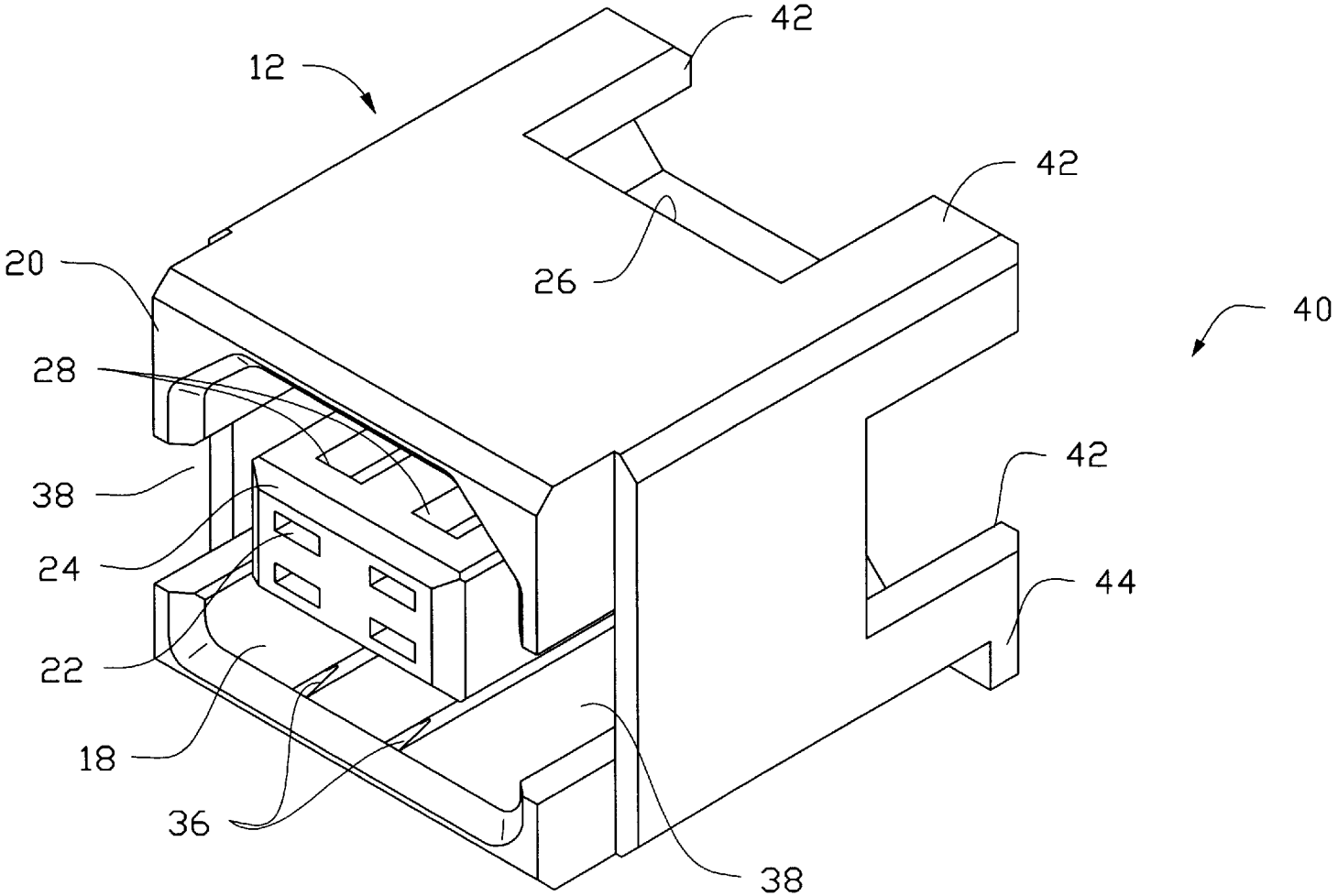
FIG. 4 is a front, top perspective view of the housing of the USB connector shown in FIG. 2.

Referring now to FIGS. 2 and 3, a shielded USB electrical connector according to the present invention is generally designated at 10. The USB connector 10 mainly comprises an insulating housing 12, a plurality of conductive contacts 14 and a shielding device 16. Please also refer to FIG. 4, where the housing 12 comprises an annular recess 18 formed on a front face 20 thereof for receiving an external mating USB plug connector not shown) and four passageways 22 defined in a central portion of the front face 20 surrounded by the recess 18. The passageways 22 extend from the front face 20 to a rear face 26 of the housing 12 for receiving the contacts 14.

A pair of apertures 28 are provided on the upper surface of the central portion 24 communicating between the upper passageways 22 and the recess 18 so that the contacts 14 received in the passageways 22 may extend their contacting portion 114 out of the aperture 28 for engaging a contact of the mating connector (not shown). Similarly, A pair of apertures 28 are provided on the lower surface of the central portion 24 communicating between the lower passageways 22 and the recess 18 for the same purpose.

Positioning means 30 is provided on the rear face 26 for positioning the contacts 14. In one embodiment, the positioning means comprises two rows of horizontal bars 32 provided on the lower edges of the two rows of passageways 22, constituting narrow, vertical channels 34 therebetween so that a portion of the contact 14 extending out of the passageway 22 is positioned in the narrow channel 34.

A number of ribs 36 are formed on the upper and lower peripheral surfaces of the recess 18 for both guiding the entering of a mating connector and firmly receiving the mating connector in the recess 18.

A pair of elongate cutouts 38 are provided on both sides of the recess 18 for receiving a portion of the shielding device 16, which will be described in more detail later.

Figure 5:
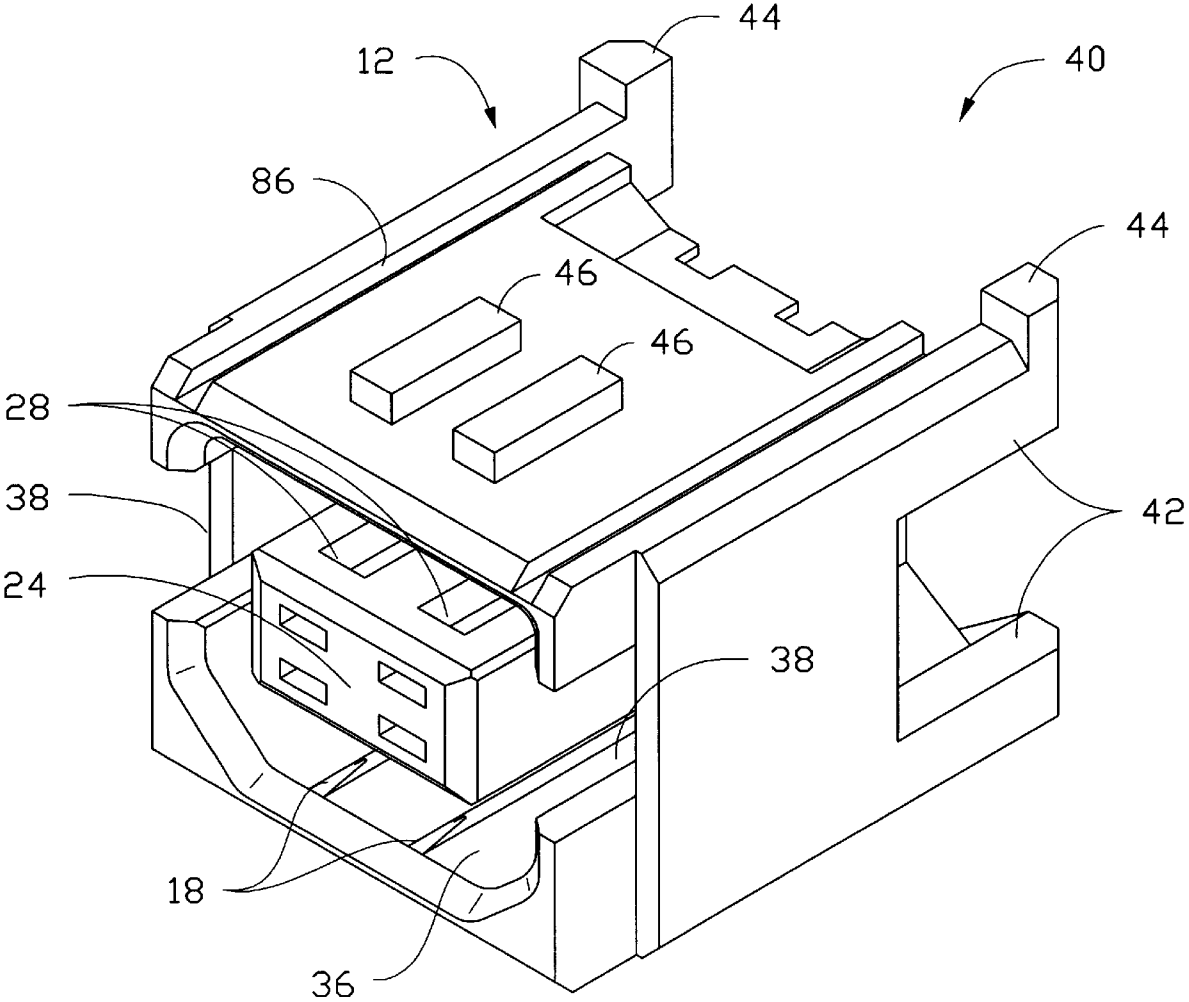
FIG. 5 is a front, bottom perspective view of the housing of the USB connector shown in FIG. 2.
Figure 7:
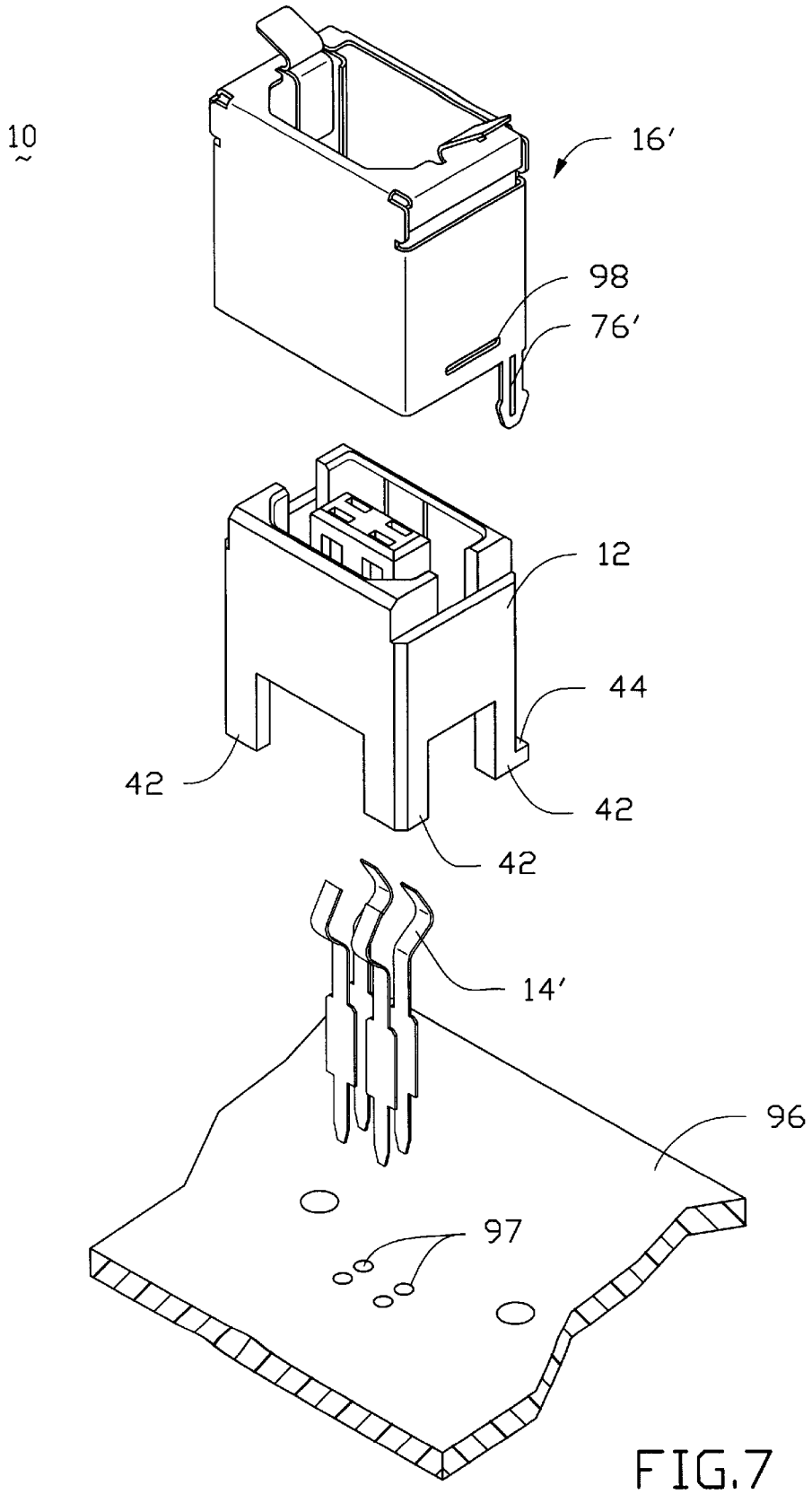
FIG. 7 is an exploded perspective view of a USB connector according to another embodiment of the present invention showing a vertical type connector arrangement.

Please also refer to FIG. 5. The housing 12 further comprises standoff means 40 to avoid molten solders and flux penetrating into the interior of the connectors owing to capillary effect. The standoff means 40 comprises four standing posts 42 extending rearward from four corners of the housing 12, a pair of standoffs 44 provided on a bottom surface of a distal end of the pair of lower standing posts 42, and a pair of standoffs 46 provided on a bottom surface of housing 12. When used in a horizontal type connector, as shown in FIGS. 2 and 3, the housing 12 stands in a horizontal position at its four standoffs 44, 46 on a circuit board (not shown), while used in a horizontal type connector, as can be seen in FIG. 7, the housing 12 stands in a vertical position at its four standing posts 42. Detailed description regarding the orientation arrangement of the present connector will be discussed later.

Figure 6:
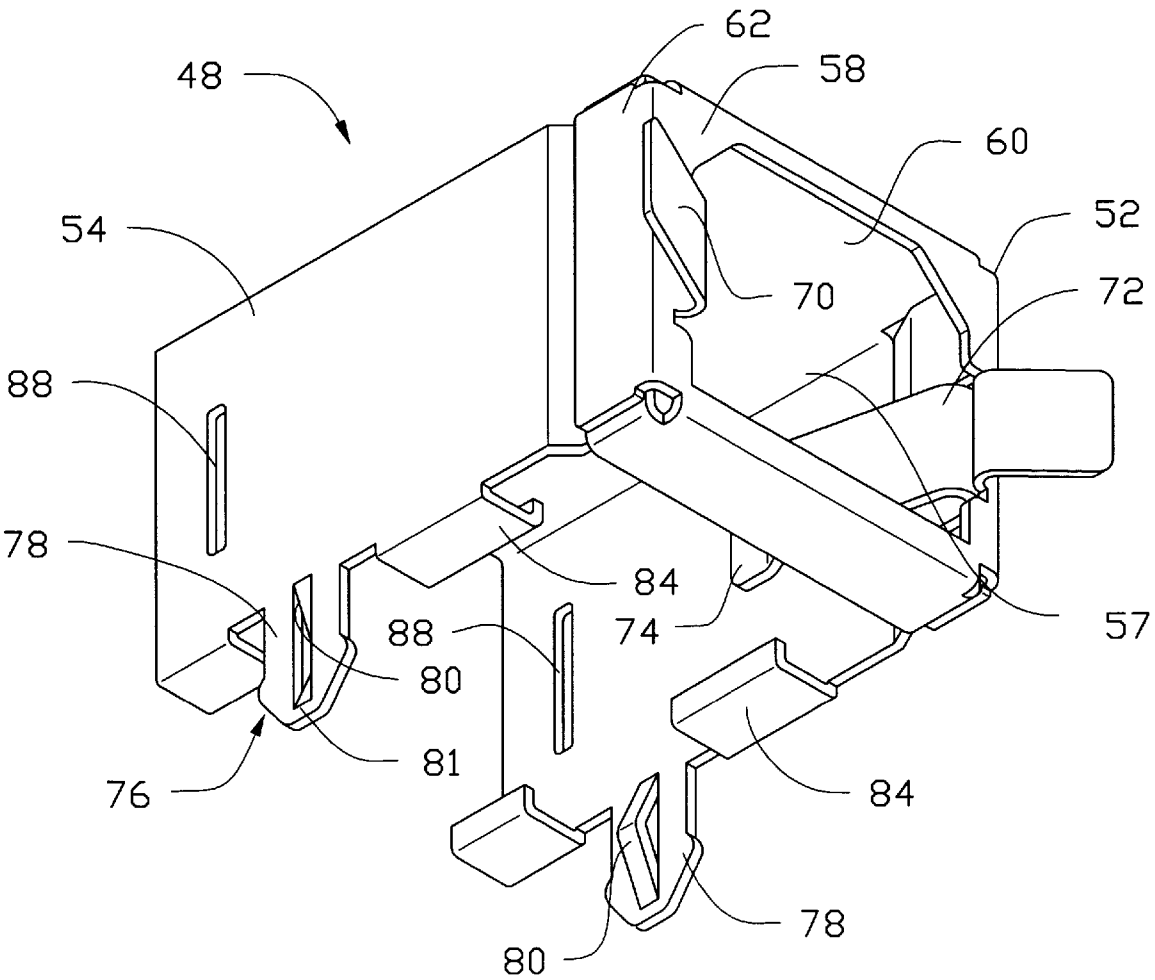
FIG. 6 is a front, bottom perspective view of the front shell of the shielding device of the USB connector shown in FIG. 2.

Referring now back to FIGS. 2 and 3, one embodiment of the shielding device 16 according the present invention shown therein is of a two-piece design, comprising a front shell 48 and a rear shell 50. Please also refer to FIG. 6, the front shell 48 is of a rectangular parallelepiped shape in general and includes a front plate 52, a pair of symmetric lateral plates 54 substantially perpendicular to the front plate 52, and a top plate 56 substantially perpendicular to both the front plate 52 and the lateral plates 54. A chamber 57 is defined between these plates 52, 54, and 56 for receiving the housing 12.

The front plate 52 comprises a main plate 58 having an opening 60 on its central portion conforming to the recess 18 of the housing 12 for inserting a mating connector. The front plate 52 further comprises a pair of lateral reinforcement plates 62 bent 90 degrees from the main plate 58 to be coplanar with the lateral plates 54. The front portion of the lateral plates 54 bends slightly inward and then immediately turns to a forward direction so that the rear edge of the reinforcement plates 62 abuts to an outer surface of the lateral plates 54. The upper edge of the lateral reinforcement plates 62 support the top plate 56 at a bottom surface adjacent to a lateral edge thereof. Moreover, the front plate 52 further comprises a bottom reinforcement plates 64 bent 90 degrees from the main plate 58 and abutting the lateral reinforcement plates 62 by upward deflecting lateral end plate portions 66 of the bottom reinforcement plates 64. The lateral reinforcement plates 62, the bottom reinforcement plates 64, the upward deflecting lateral end plate portions 66, and a front portion of the top plate 56 constitute an annular reinforcement structure, which increases the strength of the shielding device 16 so as to prevent the deformation of the connector while a mating connector is inserted thereto or withdrawn therefrom.

The shielding device 16 further comprises grounding means 68 on its front portion. The grounding means 68 comprises a pair of front grounding tangs 70 extending the front plate 52 and a pair of rear grounding clips 72 each extending from one of the lateral plates 54. The grounding tangs 70 extend forward and outward from opposed lateral inner edges of the opening 60 for grounding by engaging a panel of a computer metal shell. The grounding clips 72 extend from the front edge of the lateral plate 54 and deflect rearward and slightly inward to get close to each other. The two grounding clips 72 have an outward-deflecting end portion 74 away from each other. Because of this outward-deflecting end portion 74, a mating connector can be easily disconnected from the present connector 10. The grounding clips 72 are customized to move freely in the cutouts 38 of the housing 12.

The shielding device 16 further comprises a pair of boardlocks 76 on its bottom for firmly securing to a circuit board. The boardlocks 76 comprises a vertical leg plate 78 extending downward from a lower edge of the lateral plate 54 for insertion into a hole on a circuit board and a spring piece 80 laterally stamped out from the leg plate 78, leaving an aperture 81 on the leg plate 78. The spring piece 80 is a vertical strip bent at its middle portion with both ends connected to the leg plate 78 for providing spring force against the inner wall of the hole on the circuit board. The distance between the leg plates 78 may be different from the distance between the centers of the holes on the circuit board so that the leg plates 78 may offset from the centers of the holes to more effectively lock in the holes.

In wave soldering, molten solders will fill the aperture 81 of the boardlock 76, which effects a stronger fastening structure than ever.

The shielding device 16 further comprises a pair of hook plates 82 on either sides of its bottom for firmly connecting to the housing 12. The hook plates 82 extend from a lower edge of the vertical lateral plate 54 and bend horizontally into the interior of the shielding for holding a bottom of the housing 12. The hook plates 82 further comprise an upward-bending end portion 84 for securely engaging into a pair of grooves 86 formed on the bottom of the housing 12 and adjacent to the standing posts 42 so as to avoid relative motion of the housing 12 to the shielding device 16.

The shielding device 16 further comprises a pair of vertical slits 88 formed on its rear portion for latchably connecting the rear shell 50 of the shielding device 16.

In one preferred embodiment, the present front shell 48 is manufactured by stamping and bending as a unitary piece, though the front shell according to the present invention can be implemented in more than one piece.

As can be seen in FIG. 2, in one preferred embodiment, the rear shell 50 is formed as a unitary piece comprising a main plate having a pair of lateral plate portions and a top plate portion bent forward. The lateral plate portions of the rear shell 50 include a pair of ears 90 extending therefrom with their ends deflecting outward for latchably engaging into the vertical slits 88 of the front shell 48. The vertical length of the ears 90 are substantially the same as that of the slits 88. The latching ears 90 further comprises a pair of protrusions 92 on their upper and lower edges for urging against a pair of opposite surfaces of the cooperating standing posts 42 of the housing 12.

The top plate portion of the rear shell 50 includes a snap plate 94 for engaging between the front shell 48 and the housing 12 for urging an inner surface of the top plate 56 of the front shell 48 near a rear edge when the housing 12, the front shell 48 and the rear shell 50 are assembled together.

When assembled to an external circuit board (not shown) as a connector 10, the rear side of the rear shell 50 is closed onto the front shell 48 to form a complete shielding device 16, and the shielding device 16 is attached on the circuit board by its bottom side. Therefore, an excellent shielding effect for the contacts received in the shielding device 16 can be accomplished according to the present invention.

As mentioned previously, the housing 12 according to the present invention can be used in both a horizontal and a vertical arrangement. In the embodiment shown in FIGS. 2 and 3 when the present connector is a horizontal type connector 10, the housing 12 lies in a horizontal position at its four standoffs 44, 46 on a circuit board (not shown), with the recess 18 of the housing 12 facing a horizontal direction for receiving a mating connector inserted in such a direction. In this arrangement, a number of rignt-angle type contacts 14 are inserted in the housing 12 with the rear section 112 of the contacts 14 deflecting approximately 90 degrees for insertion into the circuit board and the boardlock 76 of the shielding means 16 extending in a direction perpendicular to that of the mating opening 60 for latchably locking into the circuit board.

In another embodiment shown in FIG. 7 when the present connector is a vertical type connector 10', the housing 12 stands in a vertical position at its four standing posts 42 on a circuit board 96 with the recess 18 of the housing 12 facing an upward direction. In this arrangement, a number of straight type contacts 14' and a different shielding device 16' are used. The shielding device 16' substantially completely surround the housing 12, having a top portion substantially the same as that of the front shell 48 of the shielding device 16. The shielding device 16' also comprises a pair of boardlocks 76' on a pair of opposed sides thereof, having the same structure as the boardlocks 76 of shielding device 16 but extending in a direction opposite to, rather than perpendicular to, that of the mating opening 60. The shielding device 16' further comprises a pair of cutouts 98 on the other two opposed sides thereof for further soldering the contacts after wave soldering, or for using as an entrance for heat and exit for contacts when SMT (surface mounting technology) is implemented.

Figure 8:
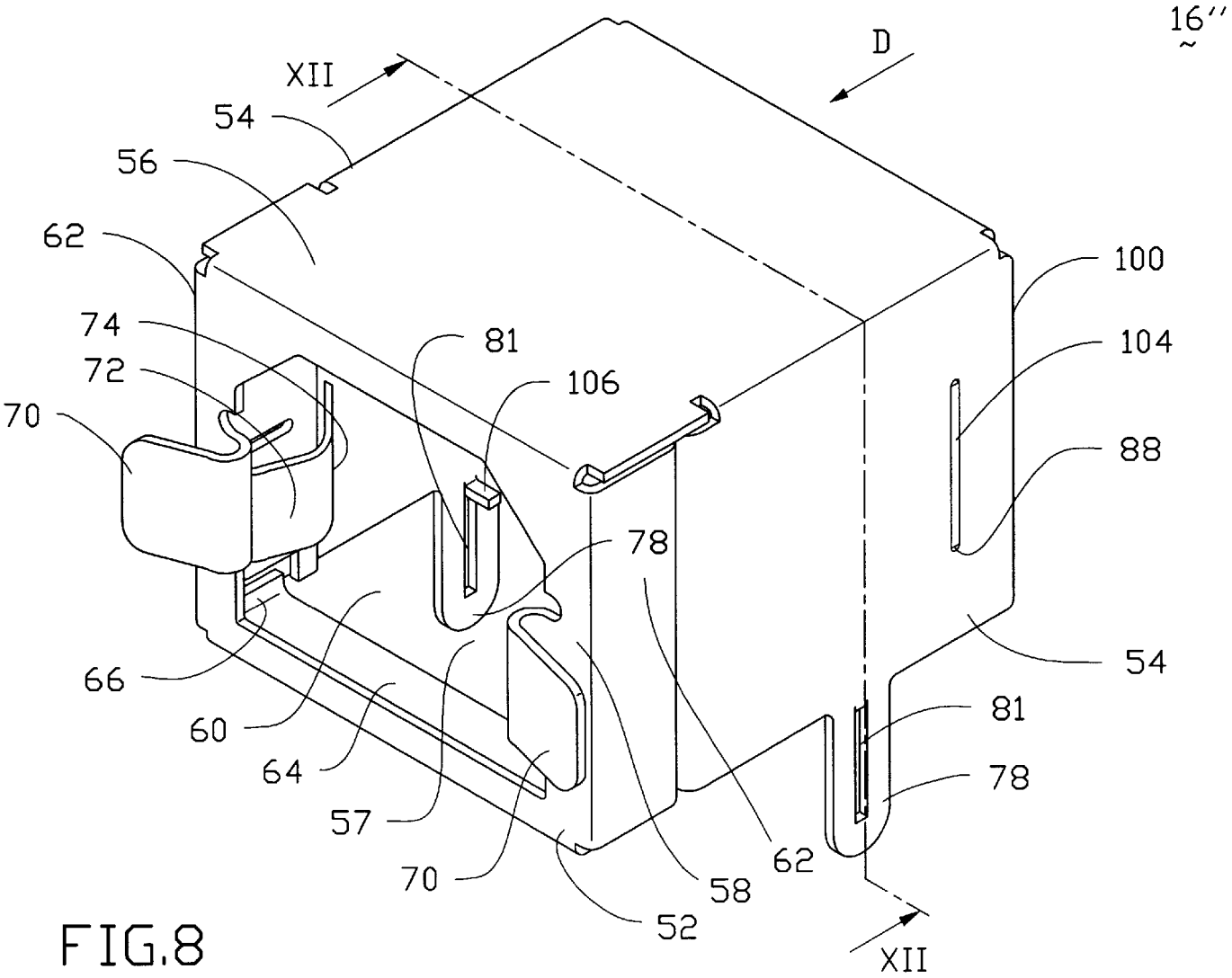
FIG. 8 is a front, top perspective view of a shielding device for the USB connector according to another embodiment of the present invention.
Figure 9:
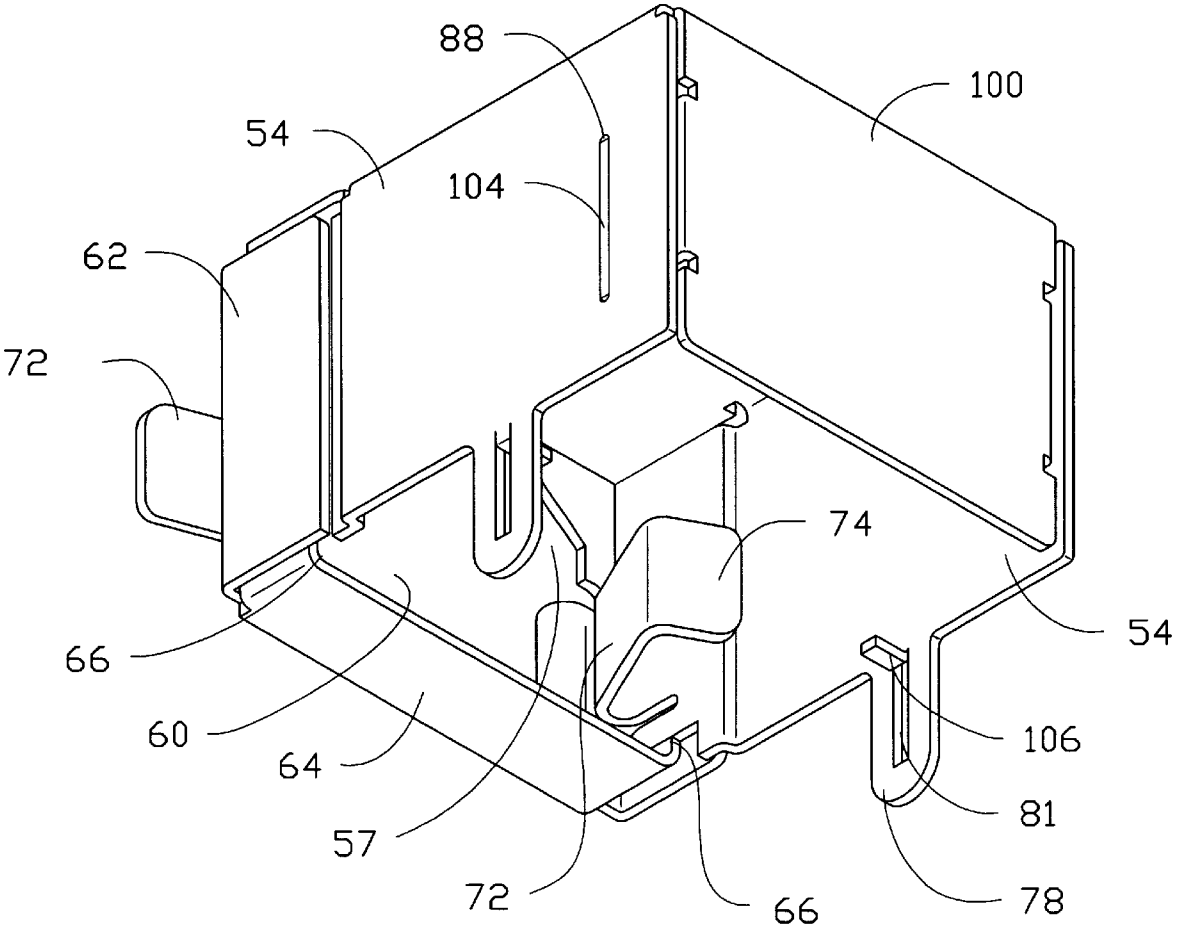
FIG. 9 is a rear, bottom perspective view of the shielding device shown in FIG. 8.
Figure 10:
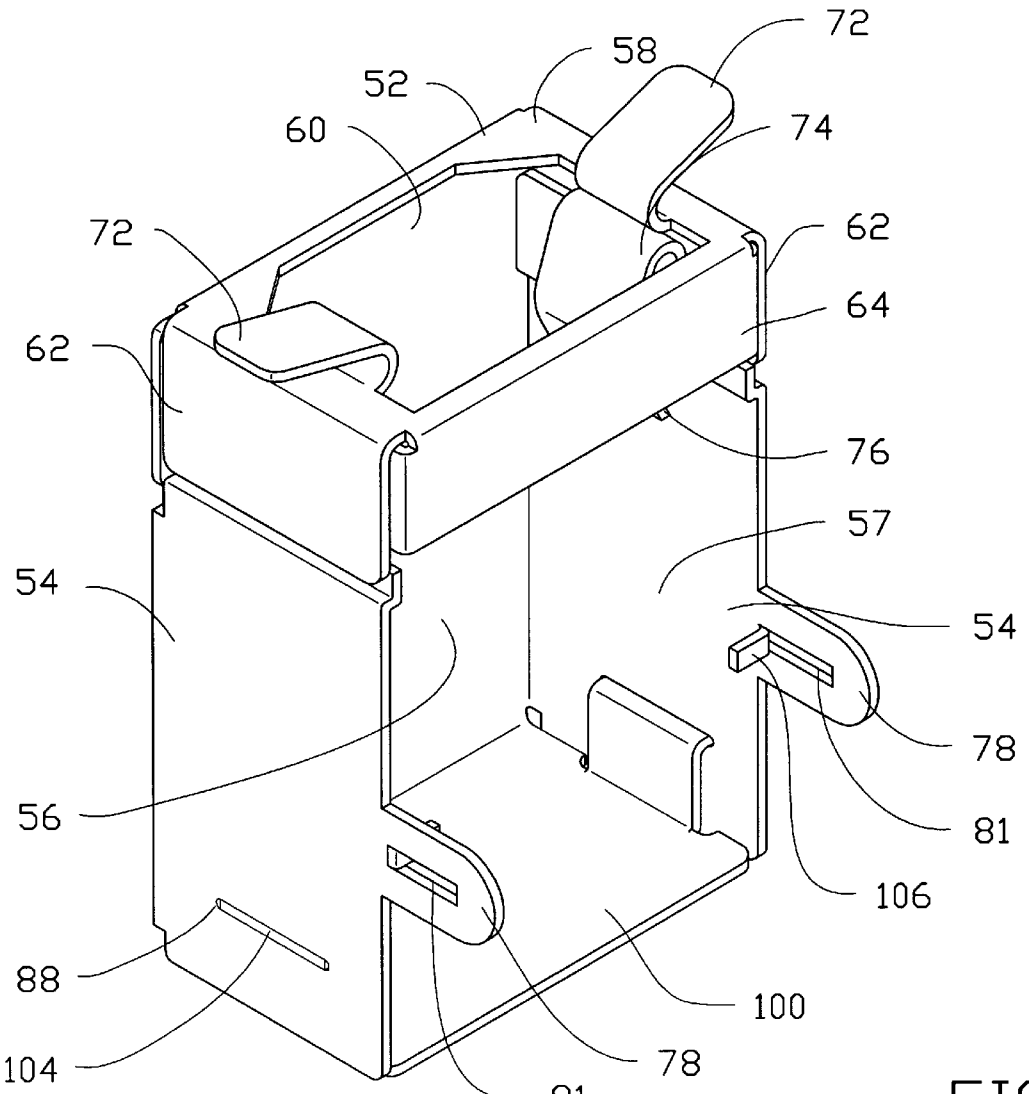
FIG. 10 is a front, bottom perspective view of the shielding device shown in FIG. 8.

Please refer to FIGS. 8 to 12, another embodiment of the shielding device for the connector according to the present invention, generally designated at 16", and its mounting to an external circuit board are shown therein. Different from the two-piece design of the shielding device 16 shown in FIGS. 2 and 3, shielding device 16" is manufactured by stamping and bending as a unitary piece. Referring now to FIGS. 8 to 10, the shielding device 16" is substantially the same as the front shell 48 of the shielding device 16, except that shielding device 16" has a rear plate 100 for shielding from the back and thus no more needs the rear shell 50. The rear plate 100 comprises a pair of ears 102 extending from two lateral edges thereof with their end portions 104 deflecting outward for latchably engaging into the vertical slits 88 of the lateral plates 54, respectively.

In assembling, the rear plate 100 is not bent perpendicular to the top plate 56 until the housing 12 with the contacts 14 disposed therein is placed into the shielding device 16" in a direction shown by arrow "D" of FIG. 8.

Figure 12:
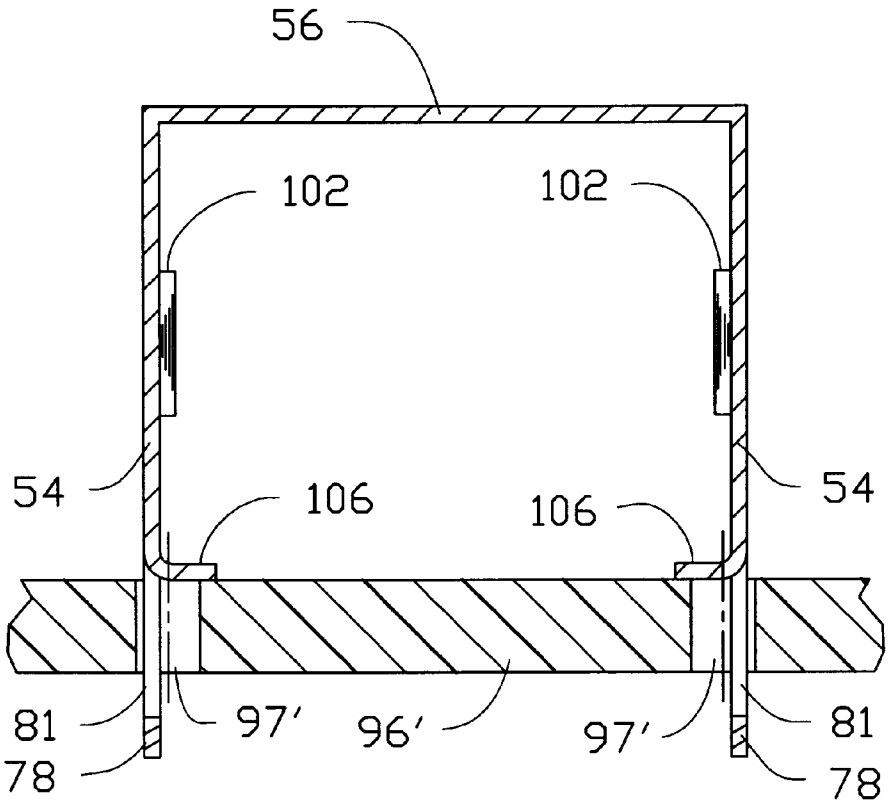
FIG. 12 is a cross sectional view of the shielding device shown in FIG. 8 mounted an external circuit board and taken from line XII—XII.

In one preferred embodiment, the vertical leg plate 78 of the boardlock 76 includes a stopper 106, rather than the spring piece 80, laterally stamped out from the leg plate 78, leaving an aperture 81 on the leg plate 78. The stopper 106 deflects inward to extend in substantially horizontal direction for abutting on the circuit board 96', as best shown in FIG. 12.

Figure 11:
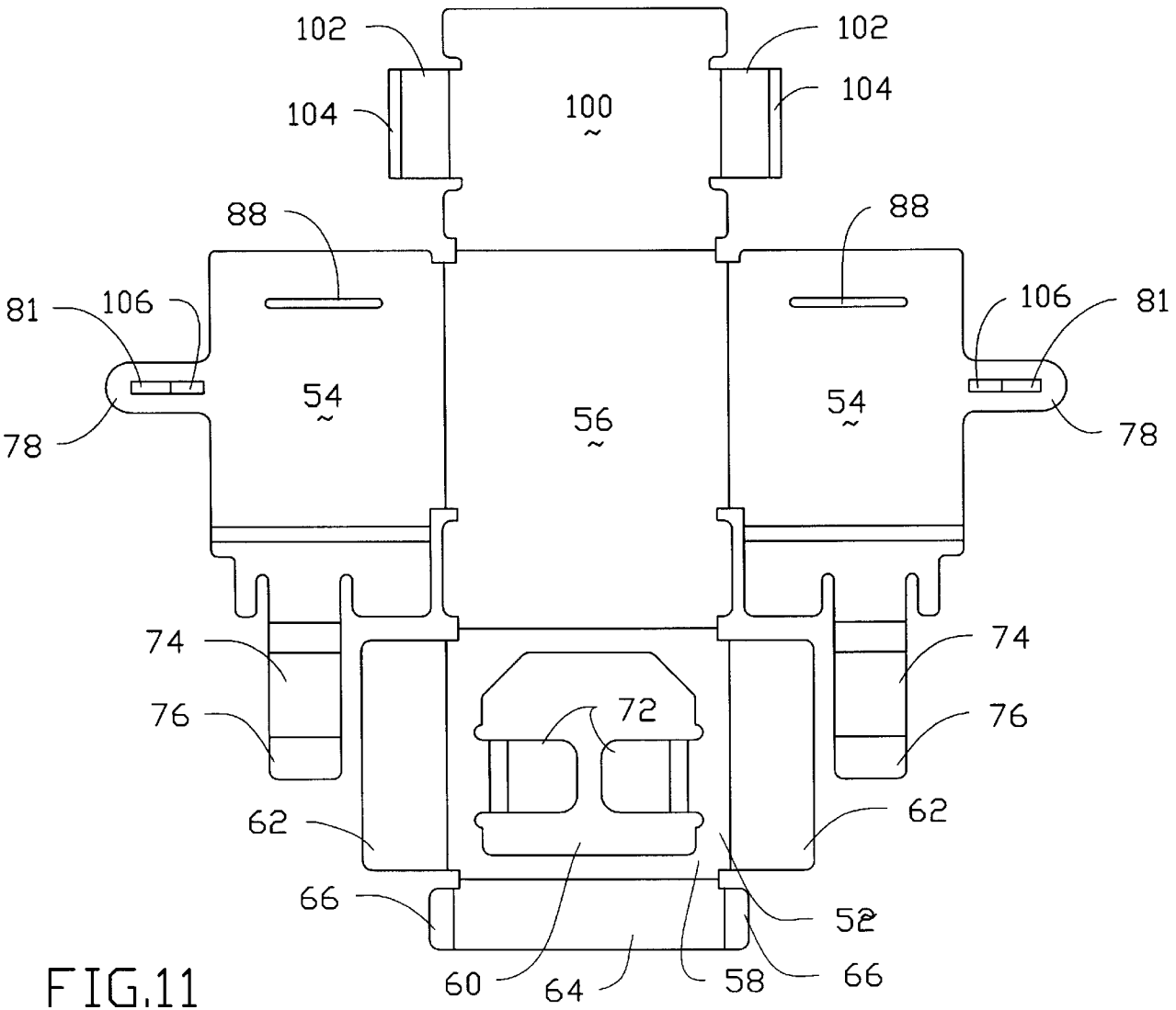
FIG. 11 is a developed plane view of the shielding device shown in FIG. 8.

FIG. 11 shows an extended plane view of the unitary shielding device 16". Obviously, the present shielding device 16" can be easily implemented by directly stamping from a metal sheet and then bending to form a shell of substantial rectangular parallelepiped. The shielding device 16", however, can also be implemented by assembling a number of metal plates into a shell.

Figure 13:
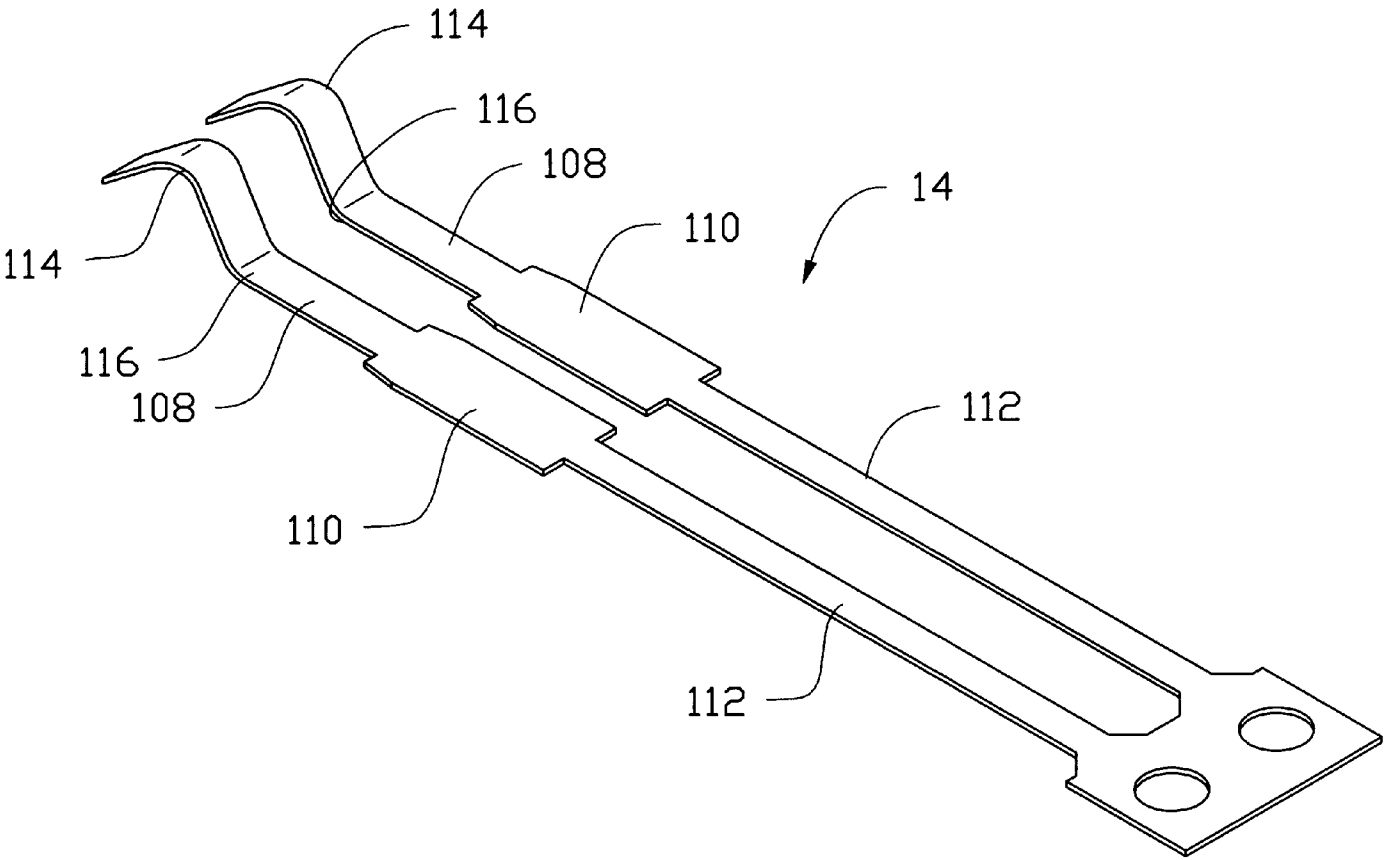
FIG. 13 shows contacts for the USB connector according to another embodiment of the present invention, which connectors are still connected to a carrier of a metal strip.

FIGS. 13 to 17 show the conductive contacts 14 according to the present invention. In FIG. 13, two successive contacts 14 are shown connected to a carrier of a metal strip. Contact 14 is generally an elongate piece stamped and formed from a metal strip and comprises a front contacting section 108, a middle fixing section 110, and a rear inserting section 112. The front contacting section 108 comprises a front, upward convex contacting portion 114 and a rear downward, convex stress releasing portion 116 remote from the middle fixing section 110. The middle fixing section 110 has an enlarged width than the front contacting section 108 and the rear inserting section 112 for interferencingly engaging the side walls of the passageway 22.

Figure 14:
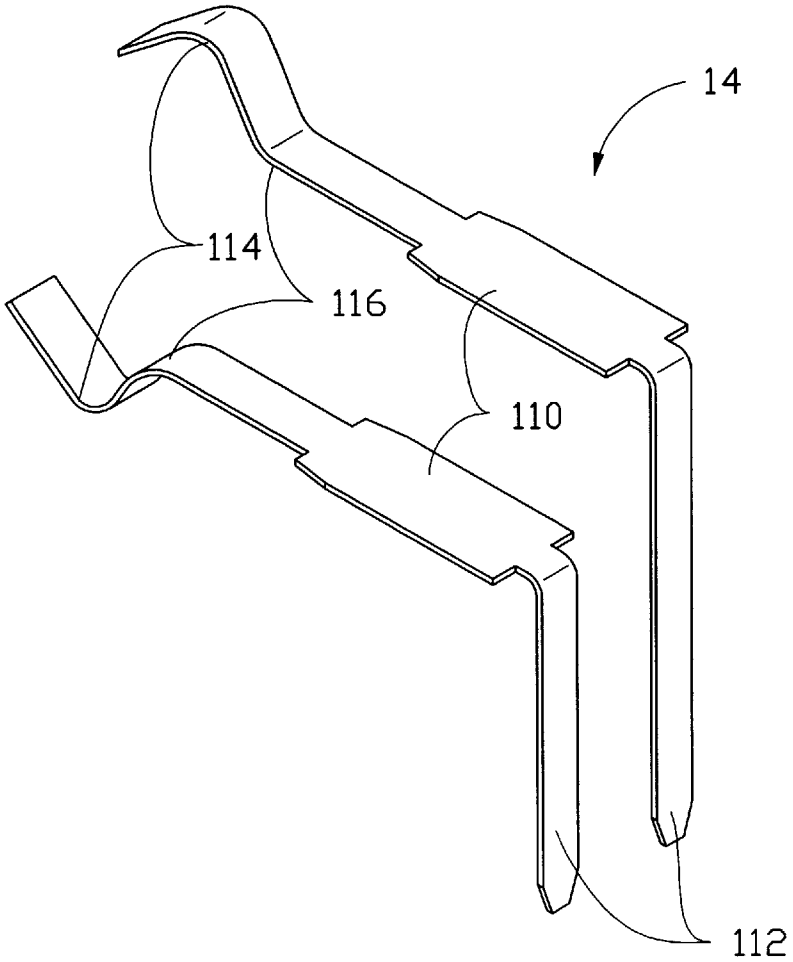
FIG. 14 shows an upper and a lower right-angle type contact according to the present invention.
Figure 15:
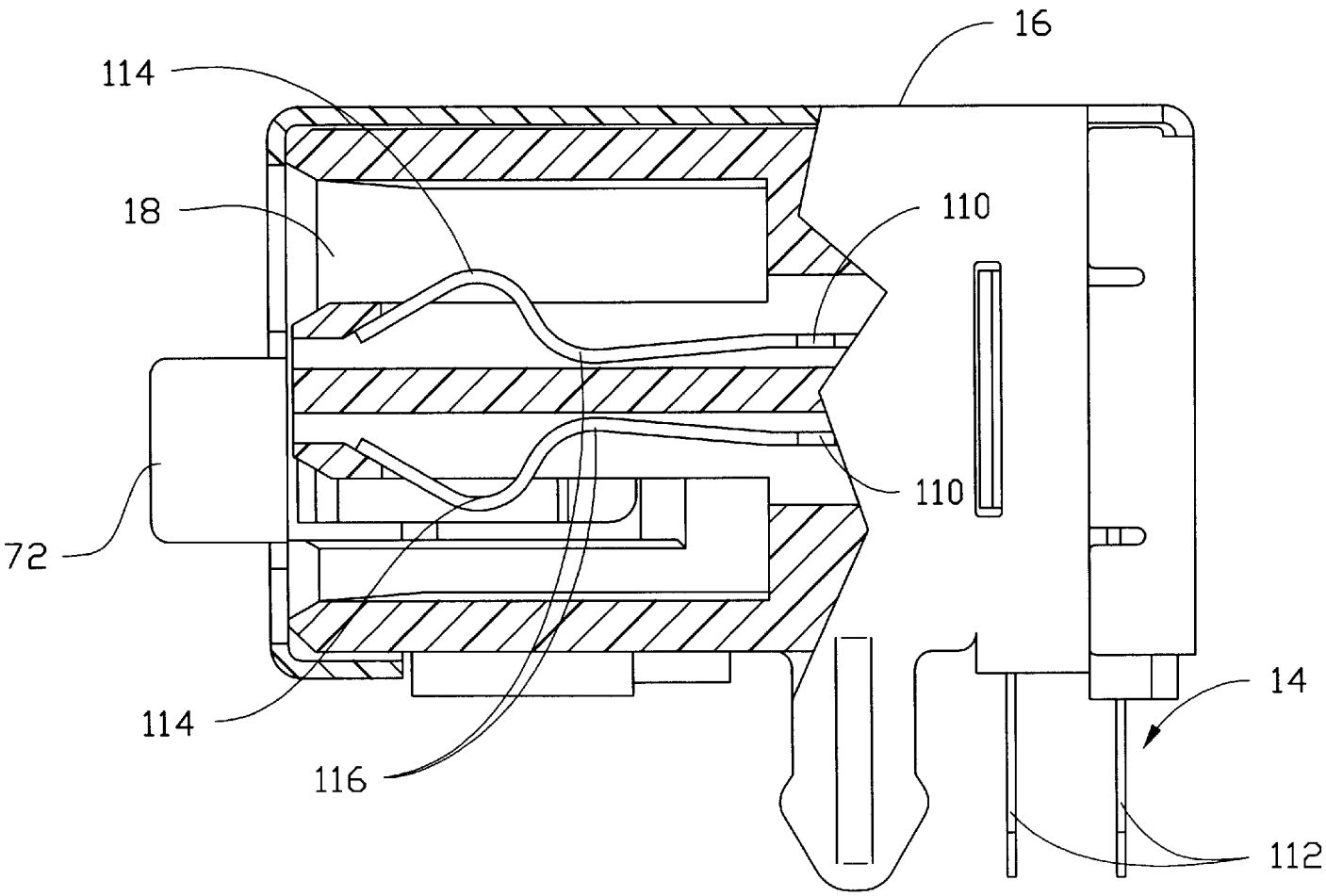
FIG. 15 shows the arrangement of the upper and the lower right-angle type contact shown in FIG. 14 in the present connector.

When used in a horizontal type connector 10, which uses a right-angle type contacts 14, as shown in FIGS. 2 and 15, the upper contacts 14 are bent right-angled downward at the inserting section 112 and the lower contacts 14 are turned up side down and then bent downward right-angled at the fixing section 110, as shown in FIG. 14. When used in a vertical type connector 10', which uses straight type contacts 14', as can be seen in FIG. 7, the contacts 14' need not to be bent, but one row of contacts 14' need to be turned 180 degrees to be opposed to the other row of contacts 14'. The contacts 14 or 14' are then inserted into the passageways 22 of the housing 12, with the lateral edges of the fixing section 110 interferencingly engaging the side walls of the passageways 22. The inserting section 112 of the contacts 14 is positioned by the positioning means 30 of the housing for keep accurate relative positions between two contacts so as to facilitate alignment of the inserting section 112 with the holes to be inserted on the circuit board.

The arrangement and functioning of the present contacts will now be described in detail hereafter. Since the arrangement of the upper and lower contacts 14 in the passageways 22 are symmetric to each other, and the same happens to the two opposed rows of the contacts 14', only the upper contacts 14 are explained.

When the upper contacts 14 are mounted into the passageways 22 of the housing 12, the front end of the contacts abuts a front, slant surface of the aperture 28. The upward convex contacting portion 114 of the contacting section 108 protrudes upward out of the aperture 28 into the recess 18 but does not touch the upper surface of the recess 18. The downward convex stress releasing portion 116 of the contacting section 108 curves to an direction contrary to the contacting portion 114 but does not touch the lower surface of the passageway 22.

Figure 16:
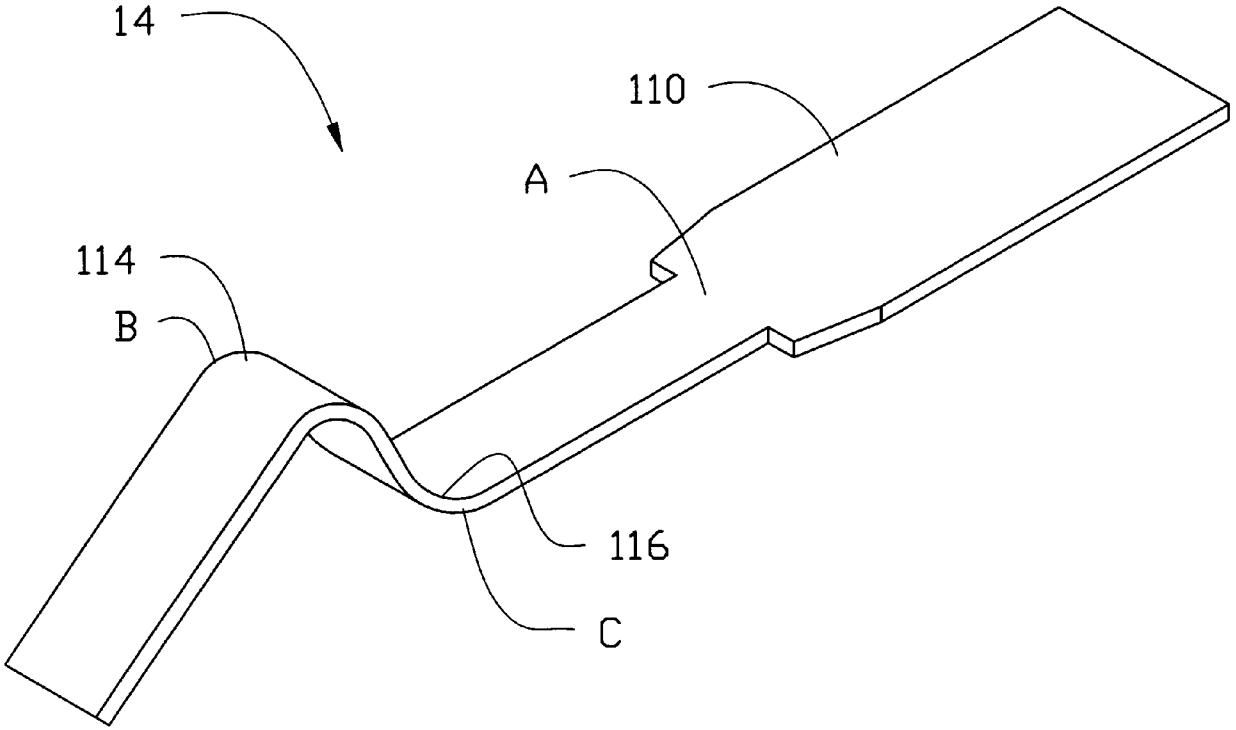
FIG. 16 is a graph showing distribution of the stresses of the front section of a contact only pivoting at one point.

When a mating connector is inserted into the present connector, the front slope of the contacting portion 114 of the upper contact encounters the mating contact first and is pressed downward. The downward convex stress releasing portion 116 approaches but does not touch the lower surface of the passageway 22, and the front section 108 behaves like a cantilever beam pivoting at the junction "A" to the middle section 110 with an external force acting on a contact point "B" on the contacting portion 114 by the mating contact. At this moment, the stresses resulted from the mating contact concentrate on the junction between the front section 108 and the middle section 110, as can be seen in FIG. 16.

Figure 17:
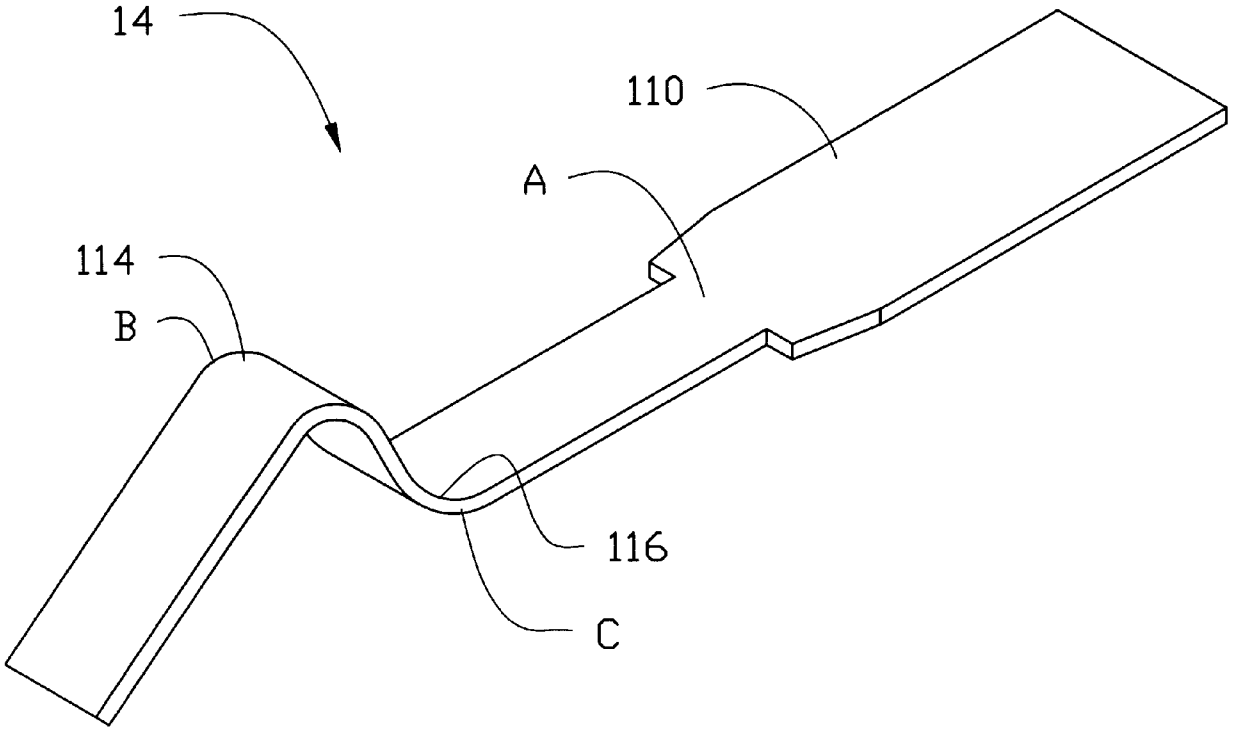
FIG. 17 is a graph showing distribution of the stresses of the front section of a contact while supporting at three points.

After further advancing of the mating connectors, the lower convex stress-releasing portion 116 further goes down and then abuts the lower surface of the passageway 22, the front section 108 is further supported at a lower contact point of the stress-releasing portion 116 so that the stresses on the front section 108 are distributed to three points—the pivoting point "A" at the junction, the upper contact point with the mating contact point "B", and the lower contact point "C" with the lower surface of the passageway 22, as can be seen in FIG. 17. The stresses on the junction "A" are thus released to a lower lever than they were. This means a material of lower strength can be used instead of the currently used material yet the same function can still be reached, which lowers the material cost; or, higher safety factor or durability can be reached with the same material, which raises the quality of the product at the same cost as before.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

I claim:

1. An electrical connector, comprising:

an insulating housing having a front face for mating a mating connector, a plurality of passageways defined in the housing and perpendicular to said front face, and standoff means for standing off on a circuit board in one of the two arrangements: a vertical arrangement in which the front face faces an upward direction that is substantially perpendicular to the circuit board and a horizontal arrangement in which the front face faces a lateral direction that is substantially parallel to the circuit board; and a plurality of contacts received in said plurality of passageways and extending out of a rear face of said housing;

wherein said standoff means comprises four standing posts extending rearward from four corners of the housing for standing off in the vertical arrangement, and a pair of first standoffs extending from a lower pair of the standing posts and at least one second standoff provided on a bottom face of the housing for standing off in the horizontal arrangement.

2. The electrical connector as claimed in claim 1, wherein said plurality of passageways are defined in a central portion of the housing and said housing comprises an annular recess defined around said central portion for receiving a mating connector, and said housing further comprises an aperture for each passageway to be in communication with the recess and said contacts received in the passageways each have a contacting portion bulging out of the aperture for engaging a mating connector.

3. The electrical connector as claimed in claim 2, wherein said annular recess comprises at least one rib on a peripheral surface thereof for firmly receiving the mating connector in said annular recess.

4. The electrical connector as claimed in claim 1, further comprising a shielding device surrounding said housing, and wherein said housing comprises a center portion and an annular recess around the center portion, said shielding device comprising:

a first metal shell defining a chamber receiving said housing;

a front plate defined on the first shell having an opening conforming to and confronting said annular recess of the housing for insertion of the mating connector;

at least one lateral plate defined on the first shell substantially perpendicular to the front plate; and a grounding clip integrally extending rearward and deflecting lightly inward from a front portion of said at least one lateral plate and having an end portion deflecting outward for facilitating withdrawal of the mating connector.

5. The electrical connector as claimed in claim 4, wherein said shielding device further comprises grounding tangs integrally formed on the front plate and extending forward and outward therefrom for engaging a panel of a computer shell or the like.

6. The electrical connector as claimed in claim 4, wherein said shielding device comprises at least one boardlock, each boardlock comprising a leg plate extending downward from a lower edge of the at least one lateral plate and an aperture on the leg plate for filling solders therein in a wave-soldering procedure.

7. The electrical connector as claimed in claim 4, wherein the shielding device comprises at least one boardlock, each boardlock comprising a leg plate extending downward from a lower edge of the at least one lateral plate and a stopper stamped from the leg plate and deflecting inward for abutting on a circuit board.

8. The electrical connector as claimed in claim 4, wherein the shielding device comprises at least one boardlock, each boardlock comprising a leg plate extending downward from a lower edge of the at least one lateral plate and a spring piece stamped from the leg plate with both ends of said spring piece connected to the leg plate and a middle portion of said spring piece bulging out of the leg plate.

9. The electrical connector as claimed in claim 4, wherein the shielding device further comprises a second shell connected to a rear portion of the first shell.

10. The electrical connector as claimed in claim 4, wherein said front plate further comprises an annular reinforcement structure around the mating opening for increasing the strength of the shielding device.

11. The electrical connector as claimed in claim 10, wherein said annular reinforcement structure comprises a pair of lateral reinforcement plates and a bottom reinforcement plate.

12. The electrical connector as claimed in claim 4, wherein said first shell comprises a pair of hook plates bending upward for securely engaging a pair of grooves formed on the bottom face of the housing.

13. The electrical connector as claimed in claim 9, wherein said second shell further comprises a snap plate on a top portion thereof for engaging the first shell.

14. The electrical connector as claimed in claim 1, wherein each of said plurality of contacts comprises:

a middle fixing section for fixing into one of the passageways of the housing;

a rear inserting section extending out of the housing for inserting into the circuit board; and a front contacting section including a contacting portion convex into the annular recess for engaging a mating connector and a stress-releasing portion concave towards and spaced from an inner surface of the passageway for distributing stresses generated on the conductive contact.

15. The electrical connector as claimed in claim 14, wherein said contacting portion and said stress-releasing portion are two continuous curved portions and wherein the stress-releasing portion abuts against the inner surface of the passageway when the contacting portion of the contact is fully pressed by a mating contact of a mating connector.

* * * * *